US005664974A

United States Patent [19]

Endo et al.

[11] Patent Number: 5,664,974

[45] Date of Patent: Sep. 9, 1997

[54] MALE TERMINAL AND METHOD OF MANUFACTURING THEREOF

[75] Inventors: Takayoshi Endo; Osamu Sugiyama, both of Shizuoka-ken, Japan

[73] Assignee: Yazaki Corporation, Tokyo, Japan

[21] Appl. No.: 565,359

[22] Filed: Nov. 30, 1995

[30] Foreign Application Priority Data

Nov. 30, 1994 [JP] Japan ..... 6-297303

[51] Int. Cl.[6] ..... H01R 9/24

[52] U.S. Cl. ..... 439/884

[58] Field of Search ..... 439/877, 8, 692, 439/849, 850, 884, 825, 601, 851

[56] References Cited

U.S. PATENT DOCUMENTS

| | | | |
|---|---|---|---|
| 3,852,704 | 12/1974 | Muz | 439/851 |
| 3,864,011 | 2/1975 | Huber | 439/472 |
| 5,083,944 | 1/1992 | Pitts | 439/884 |
| 5,162,004 | 11/1992 | Kuzuno et al. | 439/845 |
| 5,207,603 | 5/1993 | Peloza | 439/884 |
| 5,254,021 | 10/1993 | Yamamoto et al. | 439/877 |

FOREIGN PATENT DOCUMENTS

| | | |
|---|---|---|
| 58-186575 | 12/1983 | Japan . |
| 2-306559 | 12/1990 | Japan . |
| 3-116572 | 12/1991 | Japan . |
| 6-188037 | 7/1994 | Japan . |

*Primary Examiner*—Neil Abrams
*Assistant Examiner*—T. C. Patel
*Attorney, Agent, or Firm*—Wigman, Cohen, Leitner & Myers, P.C.

[57] ABSTRACT

A male terminal and a method of manufacturing the male terminal is provided to improve a reliability of its connection with a female terminal. The male terminal includes a wire connection part, an electrical contact part having a base plate portion, a joint part for connecting the engagement part with the electrical contact part and an engagement part. In manufacturing, one lateral free marginal portion of the base plate portion is folded back toward the other lateral free marginal portion. A lower plate portion of the joint part extends from the base plate portion till the engagement portion and has a width larger than that of the base plate portion. The upper plate portion extends from the free marginal portion till the engagement portion and has a width larger than that of the free marginal portion. Owing the structure, the strength of the joint part can be maintained. Since the lateral free marginal portion is folded to overlay the other lateral free marginal portion, a contact piece of the female terminal is not brought into contact with a seam of the free marginal portions, so that the reliability in connection with the female terminal can be improved.

20 Claims, 4 Drawing Sheets

MALE TERMINAL AND METHOD OF MANUFACTURING THEREOF

BACKGROUND OF THE INVENTION

1. Technical Field

The present invention relates to a male terminal and a method of manufacturing it. More particularly, it relates to a mail terminal which has an electrical connection part formed by folding one lateral free margin of a base plate part toward a main portion thereof and a method of manufacturing such a male terminal.

2. Description of the Related Art

A prior art reference Japanese Unexamined Utility Model Publication Nos. 3-116572 discloses a male terminal having a wire connection part crimped and connected to a wire terminal and a electrical part comprising by a base plate part of the terminal and electrically connected to a female terminal. In this male terminal, the electrical connection part is formed by folding back both of the lateral free margins on opposite sides of the base plate part toward a central portion thereof. The electrical connection between the so-constructed male terminal and the female terminal is accomplished by a flexible contact piece of the female terminal in contact with the base plate part of the male terminal in the vicinity of a seam (abutting line) of the resulting opposed margins.

In the above mentioned connecting form, however, the flexible contact piece may fall in a recess defined between the opposed free margins, so that it would be impossible to obtain sufficient contact pressure required for the electrical connection between the male terminal and the female terminal. Further, at the margins, gilt for covering them is apt to come off during the folding process etc., so that the conductivity may be reduced. Thus, it should be understood that the abutting form between the flexible pieces of the female terminal and the seam of the folded margins causes a problem of insecure contact between the male terminal and the female terminal.

Under such a circumstance, there has been proposed a male terminal in which a seam of the folded margins is partially shifted from the center of the base plate part at the position where the flexible contact piece of the female terminal abuts on the base plate part. In detail, the seam is shifted to one lateral side of the electrical connection part in the range from a leading end thereof to the intermediate position in the longitudinal direction while the seam is arranged at the center of the base plate part in flexible contact piece does not fall in the recess about the seam so that the contact between the male terminal and the female terminal is realized at areas of the base plate part besides the seam, the stable connection therebetween can be obtained thereby to improve the reliability of connection.

In the above mentioned male terminal, however, since the seam is still arranged at the center of the electrical connection part in the width direction from the intermediate position of the part in the longitudinal direction through a position near to the-wire connection part, each of the folded margins has a narrow width on the upper side of the folded electrical connection part, so that the strength is lowered. Thus, if unexpected external force is applied on the electrical connection part, it may be deformed because of concentration of stress on a base portion of the electric connection part. It is noted that the above mentioned tendency of deformation would become greater as the male terminal is reduced in size.

SUMMARY OF THE INVENTION

It is therefore an object of the present invention to provide a male terminal which is capable of improving the reliability of connecting with a female terminal and in which no concentration of stress is caused between an electrical connection part of the male terminal and a wire connection part thereof and to provide a method of manufacturing thereof.

The object of the present invention described above can be accomplished by a male terminal for connecting a wire with a female terminal, the male terminal being to be accommodated in a connector and comprising:

- a wire connection part connected to a terminal of the wire;
- an electrical contact part electrically connected to the female terminal, the electrical contact part having a base plate portion in which one lateral free marginal portion thereof is folded back toward the other lateral free marginal portion so that a folded part of the base plate portion and an unfolded portion thereof overlaps each other;
- an engagement part arranged between the wire connection part and the electrical contact part, the engagement part being engaged in a terminal accommodating chamber of the connector when the male terminal is accommodated in the connector; and
- a joint part for connecting the engagement part with the electrical contact part, the joint part including;
  - a lower plate portion formed so as to extend from the base plate portion to the engagement portion and having a width larger than that of the base plate portion of the electrical contact part; and
  - an upper plate portion formed so as to extend from the free marginal portion to the engagement portion and having a width larger than that of the free marginal portion, the upper plate portion being folded back toward the lower plate portion when the free marginal portion is folded back toward the other lateral free marginal portion.

With the arrangement mentioned above, since the width dimensions of the upper and lower plate portions are established larger than those of the free marginal portion and the base plate portion, respectively, the strength of the joint part can be maintained. Thus, no concentration of stress is increased even if an external force is applied on the electrical contact part. Further, since a seam part is formed by folding back the lateral free marginal portion to overlay the other lateral free marginal portion, a contact piece of the female terminal is not brought into contact with the seam part.

In the present invention mentioned above, preferably, the engagement part consists of a bottom wall extending from the lower plate portion, side walls standing on both sides of the bottom wall and a top wall closing a space between the side walls and extending from the upper plate portion.

In such a case, since the bottom wall of the engagement part is formed to extend from the lower plate portion formed integral with the base plate portion while the top wall of the engagement part is formed to extend from the upper plate portion formed integral with the free marginal portion, no end face of the marginal portion facing the engagement part is formed above the base plate portion.

More preferably, a seam between the upper plate portion and the lower plate portion is arranged on an extension of another seam of the free marginal portion with the base plate portion. Also in this case, no end face of the marginal portion facing the engagement part is formed above the base plate portion.

It is also preferable that a clearance is defined between a free marginal portion of the upper plate portion and a free marginal portion of the lower plate portion. In this case, since the width dimensions of the upper and lower plate portions are established larger than those of the free marginal portion and the base plate portion, respectively, no reduction in strength is caused and no end face of the marginal portion facing the engagement part is formed above the base plate portion.

More preferably, the free marginal portion of the lower plate portion is arranged between the upper plate portion and the remaining lower plate portion. With the arrangement, the strength of the joint part can be improved.

According to the present invention, there is also provided a method of manufacturing a male terminal comprising a wire connection part connected to a wire terminal; an electrical contact part electrically connected to a female terminal, the electrical contact part having a base plate portion in which one lateral free marginal portion thereof is folded back toward the other lateral free marginal portion so that a folded part of the base plate portion and an unfolded portion thereof overlaps each other; an engagement part arranged between the wire connection part and the electrical contact part, the engagement part being engaged in a terminal accommodating chamber of a connector when the male terminal is accommodated in the connector; and a joint part for connecting the engagement part with the electrical contact part, the method comprising steps of:

forming a lower plate portion in the joint part so as to extend from the base plate portion till the engagement portion and to have a width larger than that of the base plate portion of the electrical contact part;

forming an upper plate portion in the joint part so as to extend from the free marginal portion to the engagement portion and to have a width larger than that of the free marginal portion; and folding back the upper plate portion toward the lower plate portion at the same time the free marginal portion is folded back toward the base plate portion, thereby forming the joint part:

DESCRIPTION OF THE PREFERRED EMBODIMENT

A variety of embodiments of the present invention will be described with reference to the drawings.

[the first embodiment]

Figure 1:
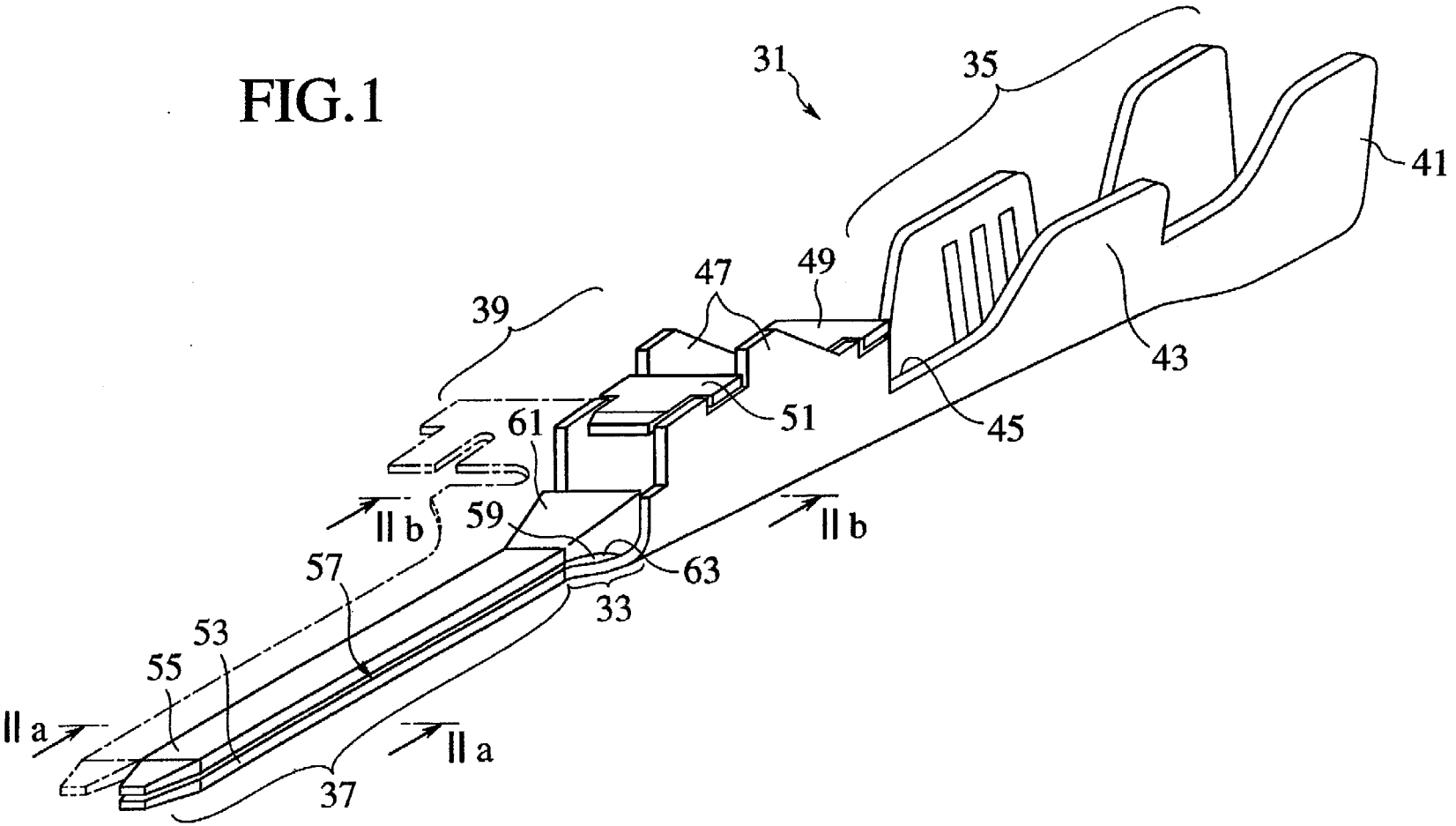
FIG. 1 is a perspective view showing a male terminal in accordance with a first embodiment of the present invention.
Figure 2A:
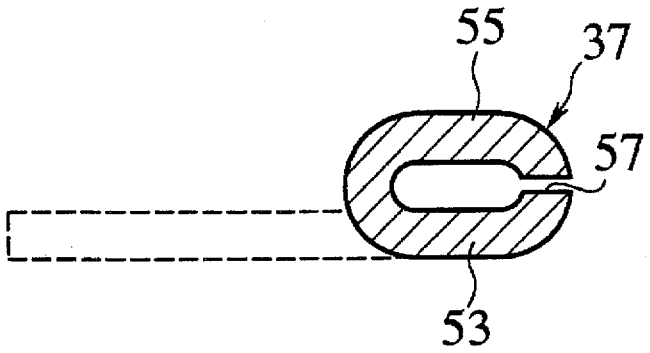
FIG. 2A is a cross sectional view of an electrical contact part of the male terminal, taken along a line IIa—IIa of FIG. 1.
Figure 2B:
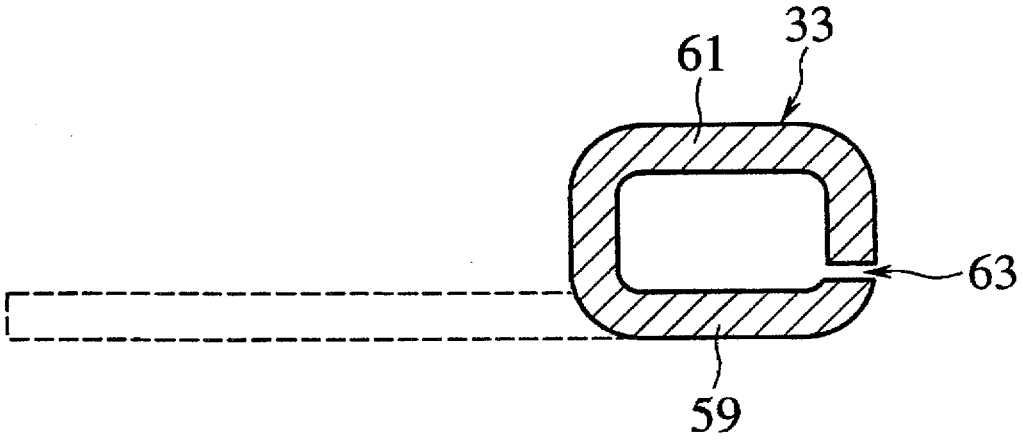
FIG. 2B is a cross sectional view of the electrical contact part of the male terminal, taken along a line IIb—IIb of FIG. 1.
Figure 3:
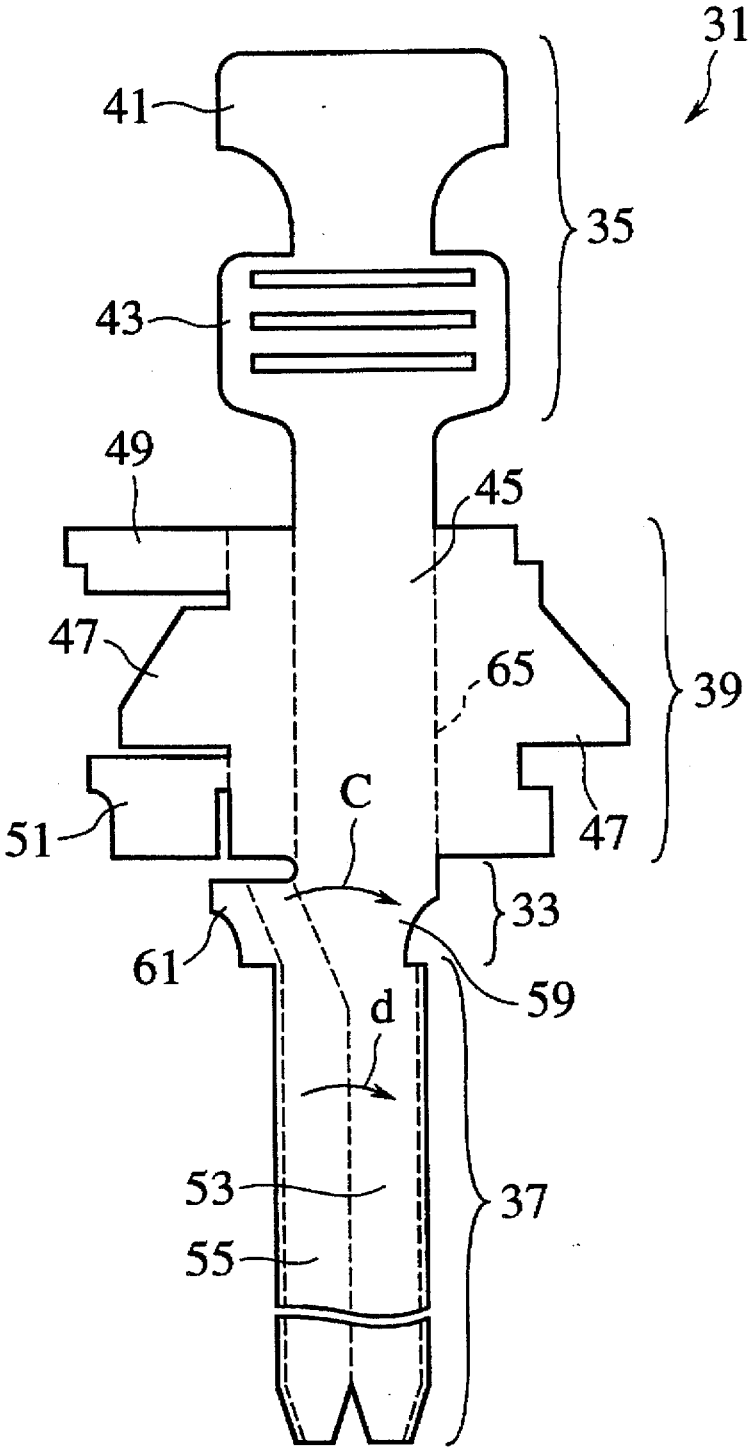
FIG. 3 is a perspective view showing the male terminal in accordance with the first embodiment in its unfolded condition.

FIG. 1 is a perspective view showing a male terminal 31 in accordance with the first embodiment of the present invention. FIGS. 2A and 2B are cross sectional views of FIG. 1, taken along lines IIa—IIa and IIb—IIb therein, respectively. Further, FIG. 3 is a plan view showing the male terminal 31 in the unfolded condition.

As shown in FIG. 1, the male terminal 31 is composed of a wire connection part 35 connected to a not-shown terminal of wire, an electrical contact part 37 electrically connected to a female terminal to be mated, an engagement part 39 arranged between the wire connection part 35 and the electrical contact part 37 to engage in a not-shown terminal accommodating chamber of a connector in accommodating thereinto, and a joint part 33 for connecting the engagement part 39 with the electrical contact part 37.

The wire connection part 35 consists of an insulative crimp section 41 to which an insulative section of the wire is to be crimped and a conductive crimp section 43 in which a conductive section of the wire is to be crimped. Both of the insulative crimp section 41 and the conductive crimp section 43 are substantially U-shaped in the same direction. The engagement part 39 is bent and formed integral with the wire connection part 35 on the side of the electrical connection part 39.

The engagement part 39 comprises a bottom wall 45 (FIG. 3), a pair of side wall 47, 47 extending from both sides of the bottom wall 45 in the same direction, and top walls 49, 51 integrally formed with either-one of the side walls 47 for closing an opening defined between one side wall 47 and the other side wall 47, providing a box configuration. When the male terminal 31 is accommodated in the terminal accommodating chamber of the connector, the engagement part 39 is retained in the terminal accommodating chamber by an engagement of the part 39 with an engagement projection formed by an inner wall of the chamber. The electrical contact part 37 is formed integral with the part 39 through the intermediary of the joint part 33.

As shown in FIGS. 1, 2A and 2B, the electrical contact part 37 of an elongated plate-shape is formed by folding back one lateral free marginal portion 55 of a base plate portion 53 toward the other lateral free marginal portion so that a folded part of said base plate portion overlaps the remaining base plate portion. Thus, a seam 57 where an edge of the unfolded base plate portion 53 abuts an edge of the free marginal portion 55 is positioned on one side of the side walls 47 of the engagement part 39. In other words, the seam 57 is positioned on the lateral side of the engagement part 39. The electrical contact part 37 is fitted into the not-shown female terminal and electrically connected thereto.

As shown in FIGS. 1 and 3, the joint part 33 consists of a lower plate portion 59 extending between the base plate portion 53 of the electrical contact part 37 and the engagement part 39 and an upper plate portion 61 extending from-the free marginal portion 55 toward the engagement part 39 to be folded over the lower plate portion 59. The lower plate portion 59 is of greater width in comparison with that of the base plate portion 53 of the electrical contact part 37 while the upper plate portion 61 is of greater width in comparison with that of the free marginal portion 55. A seam 63 defined between the upper plate portion 61 and, the lower plate portion 59 is arranged on an extension of the seam 57 between the base plate portion 53 and the free marginal portion 55. The joint part 33 is formed in a manner that width and height dimensions thereof are gradually increased from the electrical contact part 37 till the engagement part 39.

We now describe a method of manufacturing the above mentioned male terminal 31.

As will be obvious from FIG. 3, the male terminal 31 is provided in the unfolded condition by stamping out a thin plate (not shown). Then, the unfolded male terminal 31 is folded along lines 65 shown with dotted lines. In folding, the electrical connection part 35 is bent into a substantial U-shape so as to contain the wire therein. On the other hand, the engagement part 39 is folded so as to be substantially a box. In the electrical contact part 37, the free marginal portion 55 is folded back toward the base-plate portion 53 to overlie thereon. At this time, the upper plate portion 61 is also folded back and overlaid on the lower plate portion 59 so that the seam 63 between the lower plate portion 59 and the upper plate portion 61 is arranged on the extension of the seam 57 defined between the free marginal portion 55 and the base plate portion 53 ( in the directions of c and d in FIG. 3). In this way, the male terminal 31 is manufactured.

According to the embodiment, since the width dimensions of the upper and lower plate portions 61 and 59 are greater than those of the free marginal portion 55 and the base plate portion 53, respectively, the strength of the joint part 33 can be maintained, so that no concentration of stress occurs even if an external force is applied thereto. Consequently, it is possible to improve the strength of the male terminal 31.

Additionally, in the embodiment, an end surface of the free marginal portion 55 is not arranged above the base plate portion 53. Therefore, even if the external force is applied, the stress does not concentrate at a point, whereby the strength of the joint 33 can be increased.

Further, even when the male terminal 31 is engaged with the female terminal, the flexible contact piece does not abut on the seam 57. Therefore, since the flexible contact piece does not fall into the seam 57 so that the contact pressure does not change, the reliability in contact between the male terminal 31 and the female terminal can be improved. In addition, by forming the joint part 33 so as to have the above mentioned configuration, the strength of the joint part 33 will be maintained even if the male terminal 31 is compact. Consequently, it is possible to prevent the male terminal 31 from being deformed.

[the second embodiment]

Figure 4:
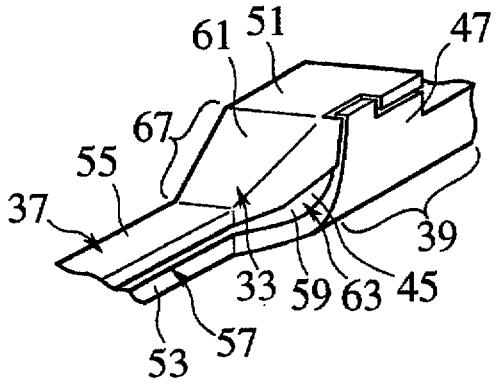
FIG. 4, is a perspective view showing a joint part of a male terminal in accordance with a second embodiment of the present invention.

Referring to FIG. 4, the second embodiment of the present invention will be described below. It is noted that this embodiment relates to an example of a joint part 67 of the male terminal having the engagement part 39 of which height is smaller than that of the first embodiment. The joint part 67 is composed of the lower plate portion 59 which extends from the base plate portion 53 and of which width is larger than that of the portion 53 and the upper plate portion 61 which extends from the free marginal portion 55 and of which width is larger than that of the portion 55. Further, the engagement part 39 comprises the bottom wall 45 extending from the lower plate portion 59, the side walls 47, 47 standing on both sides of the bottom wall 45 and the top wall 51 closing a space defined between one side wall 47 and the other side wall 47 and extending from the upper plate portion 61. Therefore, since the joint part 67 of the embodiment is adapted in such a manner that both of the upper plate portion 61 and the top wall 51 extend from the free marginal portion 55 of the electrical contact part 37, any portion of discontinuity does not appear in the joint part 67.

According to the embodiment, as similar to the previous, embodiment, since the upper and lower plate portions 61 and 59 are formed wider than the free marginal portion 55 and the base plate portion 53, respectively, the strength of the joint part 33 can be maintained and any portion of discontinuity does not appear.

Furthermore, since the top wall 51 of the engagement part 39 is formed to extend from the upper plate portion 61, it is possible to further improve the strength of the joint part 67.

Also in the embodiment, even when the male terminal is engaged with the female terminal, the flexible contact piece does not abut on the seam 57. Therefore, since the flexible contact piece does not fall into the seam 57 so that the contact pressure does not change, the reliability in contact between the male terminal and the female terminal can be improved.

[the third embodiment]

Figure 5:
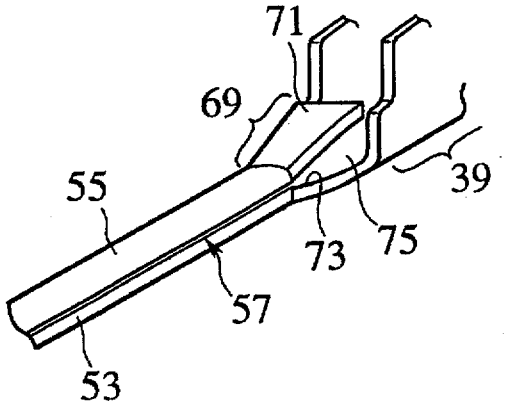
FIG. 5 is a perspective view showing a joint part of a male terminal in accordance with a third embodiment of the present invention.

Referring to FIG. 5, the third embodiment of the present invention will be described below. According to the embodiment, the male terminal has a joint part 69 where a clearance 75 is defined at a seam between an upper plate portion 71 and a lower plate portion 73. Also in this case, since the upper plate portion 71 is formed so as to extend from the free marginal portion 55 while the lower plate portion 73 is formed so as to extend from the base plate portion 53, the lateral edge of the portion 55 is not positioned over the base plate portion 53, whereby any portion of discontinuity does not appear in the joint part 69. Therefore, it is expected that no concentration of stress would occur even if an external force is applied.

Furthermore, since the upper and lower plate portions 71 and 73 are respectively formed wider than the free marginal portion 55 and the base plate portion 53 in spite of the provision of the clearance 75, the strength of the joint part 69 can be maintained. Therefore, no concentration of stress would occur even if an external force is applied.

Also in the embodiment, even when the male terminal is engaged with the female terminal, the flexible contact piece does not abut on the seam 57. Therefore, since the flexible contact piece does not fall into the seam 57 so that the contact pressure does not change, the reliability of contact between the male terminal and the female terminal can be improved.

[the fourth embodiment]

Figure 6:
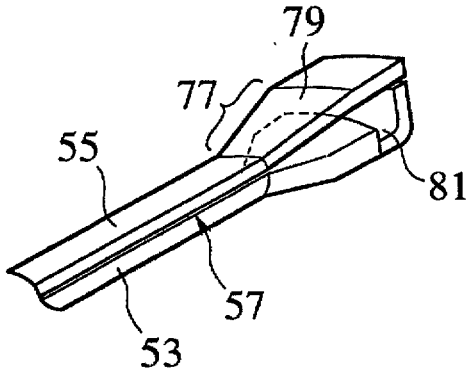
FIG. 6 is a perspective view showing a joint part of a male terminal in accordance with a fourth embodiment of the present invention.

We now describe the fourth embodiment of the present invention with reference to FIG. 6. In the embodiment, a joint part 77 is composed of an upper plate portion 79 extending from the free marginal portion 55 and a lower plate portion 81 which extends from the base plate portion 53. The free marginal portion of the portion 81 is folded back and inserted into a space defined between the upper plate portion 79 and a remaining portion of the lower plate portion 81.

Also in this case, since the upper plate portion 79 having a large width is formed so as to extend from the free marginal portion 55 while the lower plate portion 81 having a large width is formed so as to extend from the base plate portion 53, the lateral edge of the portion 55 is not positioned over the base plate portion 53, whereby any portion of discontinuity does not appear in the joint part 77. Therefore, it is expected that even if an external force is applied, no concentration of stress would occur thereby to improve the strength of the joint part 77.

According to the embodiment, since the width dimensions of the upper and lower plate portions 79, 81 are larger than those of the free marginal portion 55 and the base plate portion 53, respectively, the strength of the joint part 77 can be so maintained that, even if an external force is applied, no concentration of stress would would occur.

Furthermore, according to the embodiment, owing to the above mentioned turn-up of the free marginal portion of the lower plate portion 81, it is possible to improve the strength of the joint 77 further.

Additionally, even when the male terminal is engaged with the female terminal, the flexible contact piece does not abut on the seam 57. Therefore, since the flexible contact piece does not fall into the seam 57 so that the contact pressure does not change, the reliability in contact between the male terminal and the female terminal can be improved.

Finally, it will be understood by those skilled in the art that the foregoing description is one of preferred embodiments of the disclosed key plate structure, and that various changes and modifications may be made to the present invention without departing from the spirit and scope thereof.

What is claimed is:

1. A male terminal for connecting a wire to a female terminal, said male terminal having a central longitudinal axis and being accommodated in a connector having a terminal accommodating chamber, comprising:

a wire connection part connected to said wire;

a substantially planar electrical contact part for electrical connection to said female terminal and comprising first and second substantially planar lateral free marginal portions, said first lateral free marginal portion being folded toward the second lateral free marginal portion so as to overlap the same and form an electrical contact part seam therebetween, said electrical contact part seam being laterally offset from said central longitudinal axis;

an engagement part arranged between said wire connection part and said electrical contact part, said engagement part being engaged in said terminal accommodating chamber of said connector when said male terminal is accommodated in said connector;

a joint part for connecting said engagement part with said electrical contact part comprising an upper plate portion and a lower plate portion, said upper plate portion being folded over said lower plate portion to overlap the same and form a joint part seam therebetween, said joint part seam being laterally offset from said central longitudinal axis whereby said upper plate portion extends transversely across said central longitudinal axis.

2. The male terminal of claim 1, wherein a clearance is defined between the upper and the lower plate portions of the joint part at said joint part seam.

3. The terminal of claim 1, wherein the lower potion of the joint part has a free marginal portion, said free marginal portion being folded over into a space between the upper plate portion and the lower plate portion.

4. The male terminal of claim 1, wherein the joint part is tapered from a first cross-section at the electrical contact part to a second cross-section at the engagement part, the first cross-section being smaller than the second cross-section.

5. The male terminal of claim 1, wherein the joint part is tapered so as to converge toward the electrical contact part from the engagement part.

6. The male terminal of claim 1, wherein the engagement part has a top wall.

7. The male terminal of claim 1, wherein said electrical contact part has two lateral side edges, said electrical contact part seam being arranged along one of said lateral side edges.

8. The male terminal of claim 7, wherein said electrical contact part seam extends along the entire longitudinal extent of the one lateral side edge of said electrical contact part.

9. The male terminal of claim 8, wherein said joint part has two lateral side edges, said joint part seam being arranged along one of said lateral side edges of said joint part.

10. The male terminal of claim 1, wherein said joint part has two lateral side edges, said joint part seam being arranged along one of said lateral side edges of said joint part.

11. The male terminal of claim 9, wherein the lateral width of said joint part is greater than the lateral width of said electrical contact part.

12. The male terminal of claim 11, wherein said joint part has a width that gradually increases toward said engagement part.

13. The male terminal of claim 10, wherein the lateral width of said joint part is greater than the lateral width of said electrical contact part.

14. The male terminal of claim 13, wherein said joint part has a width that gradually increases toward said engagement part.

15. The male terminal of claim 1, wherein said joint part seam is a continuous extension of said electrical contact part seam.

16. The male terminal of claim 15, wherein said electrical contact part and said joint part have lateral side edges, the seams of said electrical contact part and said joint part being arranged along one lateral side of both said electrical contact part and said joint part.

17. The male terminal of claim 1, wherein said engagement part comprises a bottom wall, first and second side walls, and a top wall, said first side wall being connected to said bottom wall and top wall, said second side wall being connected to said bottom wall and having a free edge, said top wall having a free edge, the free edge of said top wall forming an engagement part seam with the free edge of said second wall, said seam being laterally offset from said central longitudinal axis.

18. The male terminal of claim 17, wherein the upper plate portion of the joint part extends toward the engagement part and forms the top wall of the engagement part.

19. A method of manufacturing a male terminal having a central longitudinal axis and comprising a wire connection part, a substantially planar electrical contact part having first and second substantially planar lateral free marginal portions, an engagement part between said wire connection part and said electrical contact part, and a joint part connecting said engagement part with said electrical contact part, said joint part having an upper plate portion and a lower plate portion, said method comprising the steps of:

folding said substantially planar first lateral free marginal portion over said substantially planar second lateral free marginal portion to overlap the same;

flattening said marginal portions to form an electrical contact part seam laterally offset from the central longitudinal axis of the terminal; and folding said upper plate portion over said lower plate portion to overlap the same and form a joint part seam laterally offset from the central longitudinal axis of the terminal, whereby said first lateral free marginal portion and said upper plate portion extend transversely across the central longitudinal axis of the terminal.

20. A method of claim 19, wherein said folding steps are performed substantially simultaneously.

* * * * *